United States Patent [19]

Yamada

[11] Patent Number: 5,056,672

[45] Date of Patent: Oct. 15, 1991

[54] COMPUTER CARRIER RACK WITH PLURAL SHELVES

[75] Inventor: Tetsuya Yamada, Okayama, Japan

[73] Assignee: Sanwa Supply Co., Ltd., Okayama, Japan

[21] Appl. No.: 568,095

[22] Filed: Aug. 14, 1990

[30] Foreign Application Priority Data

Nov. 18, 1989 [JP] Japan ..... 1-134165[U]

[51] Int. Cl.[5] ..... A47F 5/00

[52] U.S. Cl. ..... 211/149; 211/151; 211/195; 28/79.3

[58] Field of Search ..... 211/149, 151, 195, 198, 211/132; 248/918, 676, 678; 108/134, 99, 100; 280/79.3, 639

[56] References Cited

U.S. PATENT DOCUMENTS

| | | | |
|---|---|---|---|
| 3,827,573 | 8/1974 | Guerette | 211/149 |
| 3,891,228 | 6/1975 | Rhinehart et al. | 211/149 X |
| 3,920,258 | 11/1975 | Lundstrom et al. | 280/79.3 X |
| 3,977,689 | 8/1976 | Rosa | 280/79.3 X |
| 3,981,510 | 9/1976 | Gustafsson | 280/79.3 X |
| 4,482,066 | 11/1984 | Dykstra | 211/151 |
| 4,917,250 | 4/1990 | Barbieri et al. | 211/195 X |

*Primary Examiner*—Robert W. Gibson, Jr.
*Attorney, Agent, or Firm*—Koda and Androlia

[57] ABSTRACT

This invention relates to a relatively smallsized computer mount carrier rack which can be collapsed when it is housed, stored or conveyed. The carrier rack has such a structure that a computer mount panel is connected to the rear frame structure pivotable around a common axis of both-side joints and slidable by a pair of pins of the joints with respect to left and right columns of the rear frame structure, the rear frame structure is provided with left and right side frame structures which are connected thereto by pivotable joints and collapsible one over the other by rotating them around the axes of the joints so as to overlay the side frame structures on the rear frame structure and deform three structures into triple layer, and that the folded computer mount panel is received within a space defined by the rear frame structure and the collapsed side frame structures, thereby deforming the whole of the disassembled carrier rack into planar configuration.

1 Claim, 4 Drawing Sheets

COMPUTER CARRIER RACK WITH PLURAL SHELVES

BACKGROUND OF THE INVENTION

1. Industrial Field of the Invention

The present invention relates to a computer mount carrier rack and, more particularly, to a assemblytype carrier rack having a plurality of shelves, which completed carrier rack can accommodate various kinds of OA instrument, and can be folded up upon transportation/ storage to reduce the dimensions and volume of the disassembled carrier rack. Each of the shelves are disposed in a vertically spaced relationship.

2. Description of the Prior Art

A rack which can place some kinds of OA instrument on its own shelves in a stacked condition, enables a combination between a computer, CRT, a printer and some other things to be laid out vertically, so that such rack has been widely used due to a merit of occupying less space and effectiveness in operations. A conventional rack generally comprises a few of shelves mounted within an elongated frame structure whose lower portion is flared, and carrier wheels (casters) equipped at the bottom of the frame structure. Besides, some racks including table panels on which key boards are mounted, are available. This kind of table panel is set to be mounted on the intermediate portion of the frame structure and projects from the front face of the rack structure. There can be also seen another rack, having a disassembly structure permitting the table panel to be accommodated within side frames.

Regarding to the sale styles in market of multishelf racks, two kinds of racks are available in the market. That is to say, one is a prefabricated rack and the other is rack parts to be fabricated by a user. In the latter case, the user assembles a rear frame structure and side frame structures by screw fasteners with using the tools. The former racks, which have been already assembled in the form of multi-shelf type upon sales distribution, are not only bulky during storage or in the route of market, but also have difficulty in delivering them to the user. On the other hand, the rack which needs to assemble each of components by the user often requires the exclusive tools for assembling them. In addition, it has further problems to be solved, including such tedious work as assembling a number of parts and the consumption of time required for assembling operations. Similar to the above case, when the rack has been disused, the tedious operations for disassembling the carrier rack has to be taken and it is necessary to prepare a storing space for the disassembled rack components.

SUMMARY OF THE INVENTION

The inventors have solved the above-described problems by taking such structure for a rack that the rack can be readily assembled by a quick operation, in which the improvement is characterized by comprising a vertically elongated rear frame structure of a generally rectangular shape; a computer mount panel attached on said rear frame structure so as to be slidable in the horizontal direction by joints with respect to the rear frame structure and rotatable about a common axes of the joints; side frame structures swingably connected by pivotable joints to the left and right sides of the rear frame structure; supporting portions provided on the insides of both left and right side frame structures, for supporting said plurality of shelves, each two shelves being disposed one above the other; and carrier wheels secured on the lower portions of the side frame structure. According to such a structure described previously, the computer mount panel which is swingably mounted on the left and right columns can slide horizontally and move upwardly so as to be accommodated adjacent and parallel to the rear frame structure when folded. The side frame structures are also collapsable in parallel because they are pivotably connected to the rear frame structure. The computer mount panel and side frame structures are, accordingly, folded up in a condition that they are overlaid with one another.

When fabricating the rack, on the contrary, first the left and light side frame structures are opened substantially at a right angle with respect to the rear frame structure. Then, the computer mount panel is slidingly moved toward an operator who manipulates the disassembling carrier rack while being pivotally rotated. These simple operations can be readily carried out with no assembling tool. Depending on the layout or design required by the user, the respective shelves are rid on projection pins to form the fixed mounts extending between the left and right side frame structures as well as above/below the computer mount panel, for securely setting the computer, CRT and printer on the shelves, each two shelves being one above the other.

DETAILED DESCRIPTION OF THE PREFERRED EMBODIMENT

One preferred embodiment of the present invention will be now described in detail with reference to the drawings.

Figure 1:
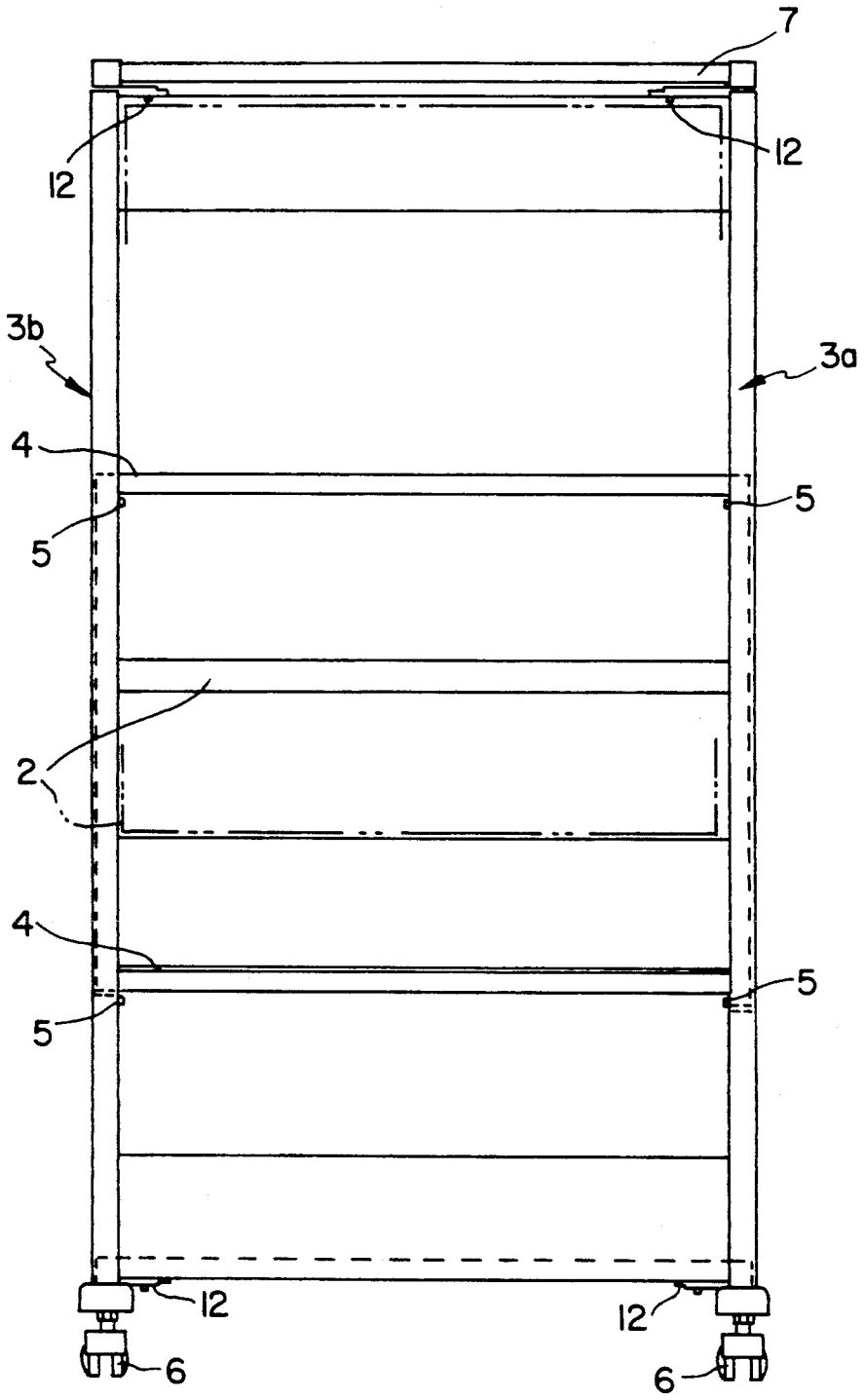
FIG. 1/is a front view illustrating a computer carrier rack having a plurality of shelves, which has been assembled, according to one preferred embodiment of the present invention.
Figure 2:
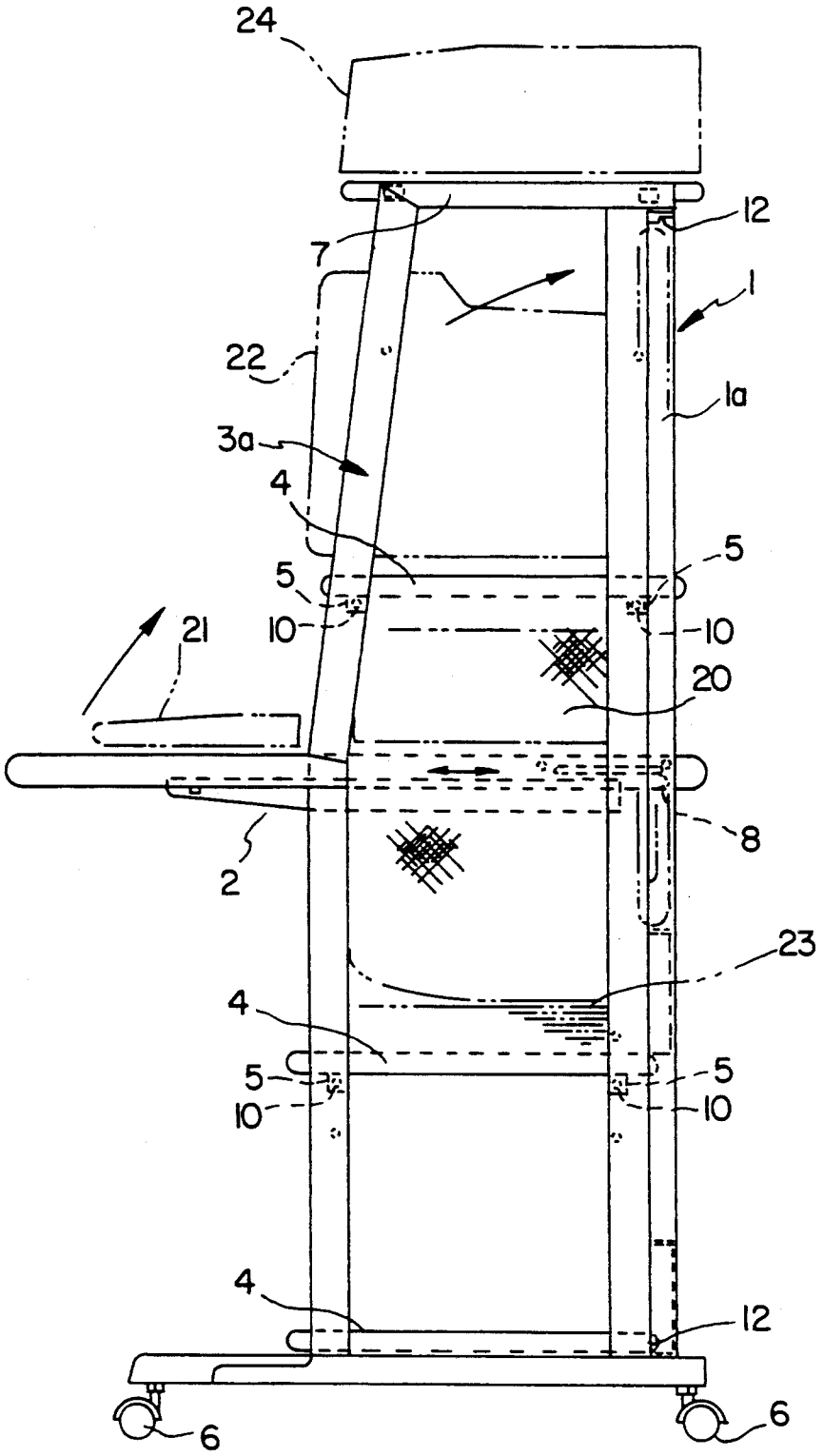
FIG. 2 is a side elevational view of the computer carrier rack shown in FIG. 1.

FIG. 1 is a front view of a computer carrier rack with a plurality of shelves after being assembled, according to the present invention, and FIG. 2 is a side elevational view of the same.

Figure 4:
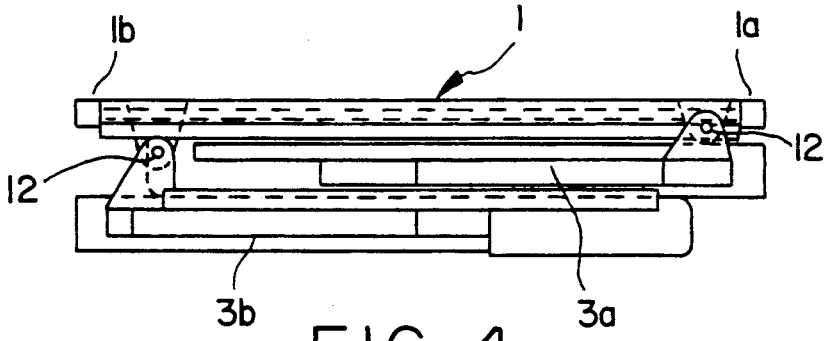
FIG. 4 is a top plan view of the same.
Figure 5:
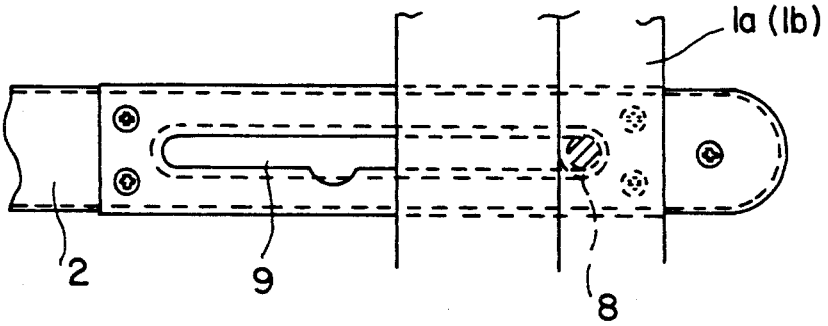
FIG. 5 is an enlarged view illustrating a slidable joint structure at the rear portion of the right side of a computer mount panel.
Figure 6:
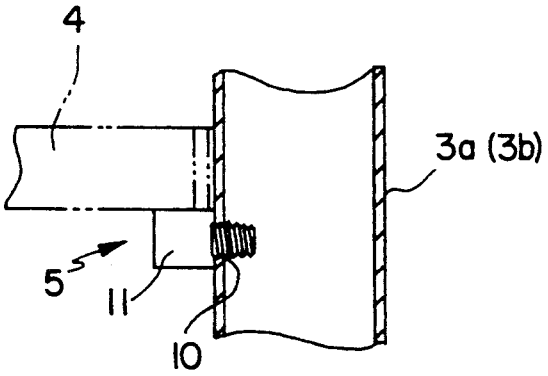
FIG. 6 is a partially cross-sectional view illustrating a portion of a side frame structure and a shelf supporting pin attached thereto, on which shelf supporting pin the corner of a shelf board is mounted.

As clearly be seen from these figures, the computer carrier rack with plural shelves includes a computer mount panel 2, which extends between both left and right columns 1*a*, 1*b* of an elongated rectangular rear frame structure 1 and is connected by joints to both columns 1*a*, 1*b* of the rear frame structure 1 so as to be rotatably moved between an upright vertical position (see FIGS. 2 to 4) and a lower horizontal position (see FIGS. 1 and 2) around the axes of the joints. FIG. 5 shows the details of the joint structure located at the rear portion of the right side of the computer mount panel 2 (the other joint structure on the left side of the panel is not shown). Bearing pins 8 are installed on the opposite columns la, lb of the rear frame structure 1, and fit into grooves 9 formed in the side portions of the computer mount panel 2. Thus, when the panel 2 is set on the horizontal position the bearing pins allow the panel 2 to be freely slidable rearward or forward in the horizontal direction within the lengths of the grooves 9. When lifting the front end of the panel 2 up and carrying the panel to the upright vertical position to lean it against the rear frame structure 1, the position of each bearing pin 8 is traveled to the front end or upper end of the groove 9. As a result, the whole panel 2 comes down to occupy the lowermost position of upright posture, as shown by a chain double-dashed line in FIG. 2, thereby retracting it without being projected from the top end of the rear frame structure 1, as well as lowering the point of the center of gravity of the panel 2 for making its stability to prevent the panel from suddenly falling forward. Side frame structures 3*a*, 3*b* are swingably connected by pivotable joints on both sides of the rear frame structure 1. The left and right side frame structures 3*a*, 3*b* are provided at their inside walls with supporting portions 5 for supporting the shelves 4 which are vertically spaced with one another. Referring to FIG. 6, one example of the supporting portion 5 is shown. As clearly be understood from this figure, the structure of each supporting portion is such that a projection pin 11 is screwed into any selected one of threaded holes 10 which is formed on each of the opposite walls of the side frame structure 3*a*. The threaded holes are arrayed vertically in spaced relation with one another. A roof pane 17 may be put on the uppermost portion of the carrier rack, and besides, there are provided carrier wheels (casters) 6 on the lower portions of the side frame structures 3*a*, 3*b*.

As being such a structure, a computer itself or a key board 21 and the like is placed on the computer mount panel 2, and CRT 22, or printing papers etc., are mounted on the shelves 4, as shown in FIGS. 1 and 2. Further, it is convenient to utilize the roof panel 7 as a shelf for positioning a printer 24.

Figure 3:
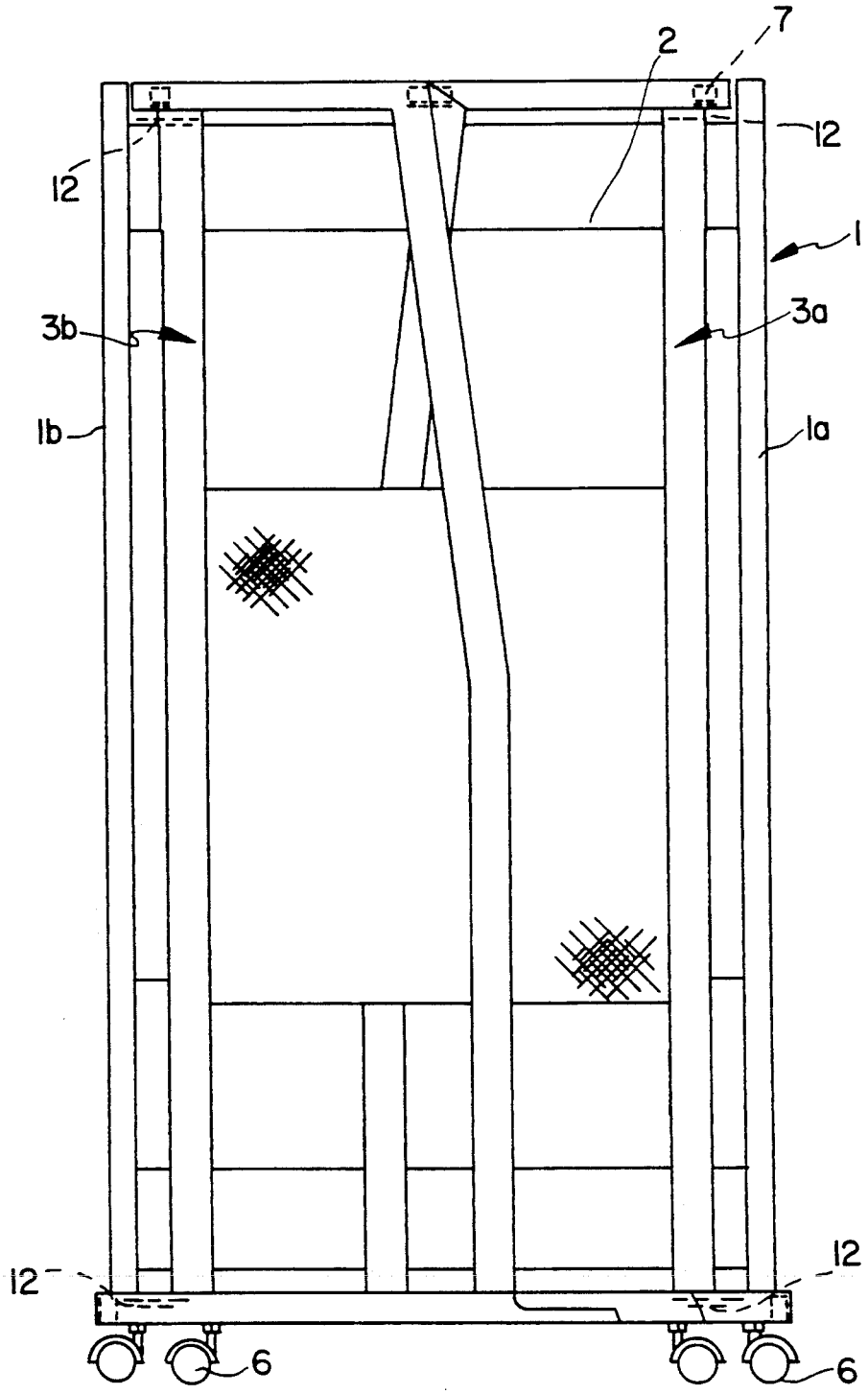
FIG. 3 is a front elevational view illustrating a folded or collapsed condition of the computer carrier rack.

This computer carrier rack with plural shelves can be readily folded without much labour when it does not in use, for example, during shipping or storage. A state of carrier rack being folded can be seen in FIGS. 3 and 4. FIG. 3 is a front eleational view showing the folded condition of carrier rack, FIG. 4 is a plan view of the same. When the carrier rack is collapsed, first the shelves 4 mounted on the projection pins of the side frame structures 3*a*, 3*b* are removed. Then, the pivotally connected computer mount panel 2 is rotated upwardly by lifting the front end of the panel up to the upright position so as to lean it against the rear frame structure 1 prior to the folding operation of side frame structures 3*a*, 3*b* connected through the pivotable joints to the rear frame structure, so that the carrier rack can be reduced in dimensions and volume whereby the whole structure of the carrier rack can be deformed into a planar configuration.

The carrier rack of the present invention has the abovementioned advantageous features, so that it does not need extra space for handling the carrier rack because of its small-sized dimensions and it is easy to transfer the carrier rack from the manufacturer or a distributor to the user. Further, no assembling tool is required and, of course, there needs to be only simple operation when the user assembles the carrier rack. Thus the assembling of the rack will not be troublesome for the user and needless to say, quick assembling operation can be carried out by him. Furthermore, when the carrier rack comes into disuse, similar to the above case, the disassembling can be readily performed with minimum labour. The user does not make tedious working to prepare a housing space for the obstructive carrier rack and to storage it without a dead space.

We claim:

1. A computer carrier rack having a plurality of shelves comprising:

a vertically elongated rear frame structure of a generally rectangular shape;

a computer mount panel attached on said rear frame structure so as to be slideable in the horizontal direction by joints with respect to the rear frame structure and rotatable about a common axis of said joints;

side frame structures swingably connected by pivotable joints to the left and right sides of the rear frame structure;

supporting portions provided on the insides of both left and right side frame structures, for supporting said plurality of shelves; and carrier wheels secured on the lower portions of the side frame structures.

* * * * *